US005417241A

United States Patent [19]

Tischer et al.

[11] Patent Number: 5,417,241

[45] Date of Patent: May 23, 1995

[54] VALVE ARRANGEMENT

[75] Inventors: Dieter Tischer, Kirchheim/Teck; Bernd Neithammer, Nürtingen, both of Germany

[73] Assignee: Hydraulic-Ring Antriebs-und Steuerungstechnik GmbH, Nürtingen, Germany

[21] Appl. No.: 48,372

[22] Filed: Apr. 15, 1993

[30] Foreign Application Priority Data

Apr. 15, 1992 [DE] Germany ..... 42 12 550.2

[51] Int. Cl.[6] ..... F15B 13/06; F15B 13/044

[52] U.S. Cl. ..... 137/596.17; 137/596.2; 137/625.68

[58] Field of Search ..... 137/596.17, 596.2, 625.68

[56] References Cited

U.S. PATENT DOCUMENTS

| | | | |
|---|---|---|---|
| 2,946,347 | 7/1960 | Ruhl | 137/596.2 |
| 3,200,841 | 8/1965 | Beutler | 137/625.68 X |
| 4,615,358 | 10/1986 | Hammond et al. | 137/596.17 X |
| 5,115,721 | 5/1992 | Ichihashi et al. | 137/596.17 X |
| 5,115,722 | 5/1992 | Ichihashi et al. | 137/896.17 X |
| 5,144,881 | 9/1992 | Cakmaz | 137/596.17 X |
| 5,209,261 | 5/1993 | Cakmaz et al. | 137/596.17 |

*Primary Examiner*—Gerald A. Michalsky
*Attorney, Agent, or Firm*—Albert H. Reuther

[57] ABSTRACT

A valve arrangement is so constructed that a pressure limitation is attainable with minimal parts expenditure and without additional structural volume in a cost advantageous manner. On a shift piston of a pathway valve, a valve member of a pressure valve is arranged therewith. The pressure valve is installed within the structural volume of the pathway valve. Via a slight modification of the shift piston of the pathway valve and installation of the valve member as a single additional structural part there is eliminated additional pressure valve structure and system connection thereof necessary with known valve arrangement. With that the inventive valve arrangement fulfills preconditions made as to a mass product including particularly nominal structural volume, nominal number of structural parts, nominal disturbance susceptibility and extremely cost-advantageous production manufacturing.

20 Claims, 4 Drawing Sheets

VALVE ARRANGEMENT

BACKGROUND OF THE INVENTION

1. Field of the Invention

The present invention concerns a valve arrangement including a pathway valve, of which the switch-shift piston is shiftable against a return force via a plunger or tappet of a magnet, and including a pressure valve, which has a valve member, that is adjustable against a reset force.

2. Background of the Invention

Such a valve arrangement is known, for example, in order to actuate a cylinder operating in opposing counter stroke. The cylinder-selection with fluid engagement respectively fluid relief occurs via the magnet-actuated pathway valve. The delivery movement occurs via engagement of the cylinder full surface with the fluid flow. The return stroke movement of the switch-shift piston occurs via the load or a restoring or return spring. The cylinder means during moving-out or extending movement generate a force which corresponds to the product of cylinder full surface and system pressure. For the purpose of system-pressure limitation on the pump side there is provided a pressure-limiting valve with which the pressure of a cylinder can be set and adjusted. If the other cylinder means are engaged with a different, lower pressure, there is necessary an additional pressure-limitation valve between the pathway valve and this cylinder. It consists of a multiplicity of parts, through which the valve arrangement is considerably more expensive. Moreover the construction volume of the valve arrangement is considerably enlarged via this additional pressure-limiting valve.

SUMMARY OF THE INVENTION

An object of the present invention basically is to construct the generic valve arrangement so that a pressure limitation is attainable cost advantageously with a minimal parts expenditure and without additional structural volume.

This object is resolved with the generic valve arrangement wherein a valve member of the pressure valve is arranged at the switch-shift piston of the pathway valve.

With the inventive valve arrangement, the pressure valve is installed within the structural volume of the pathway valve. Via a slight modification of the switch-shift piston of the pathway valve and installation of the valve member as a single additional structural part there is eliminated the additional pressure valve and the system connection thereof necessary with the known valve arrangement. Accordingly the inventive valve arrangement fulfills the preconditions which are set on such a mass product, namely nominal-small structural volume, nominal-small number of structural parts, nominal-small susceptibility to disturbance and extremely cost-advantageous production and manufacture.

Further objects and advantages of the present invention are apparent from the following description and disclosure, reference being made to the drawings setting forth features of the present invention in greater detail.

DETAILED DESCRIPTION

Figure 1:
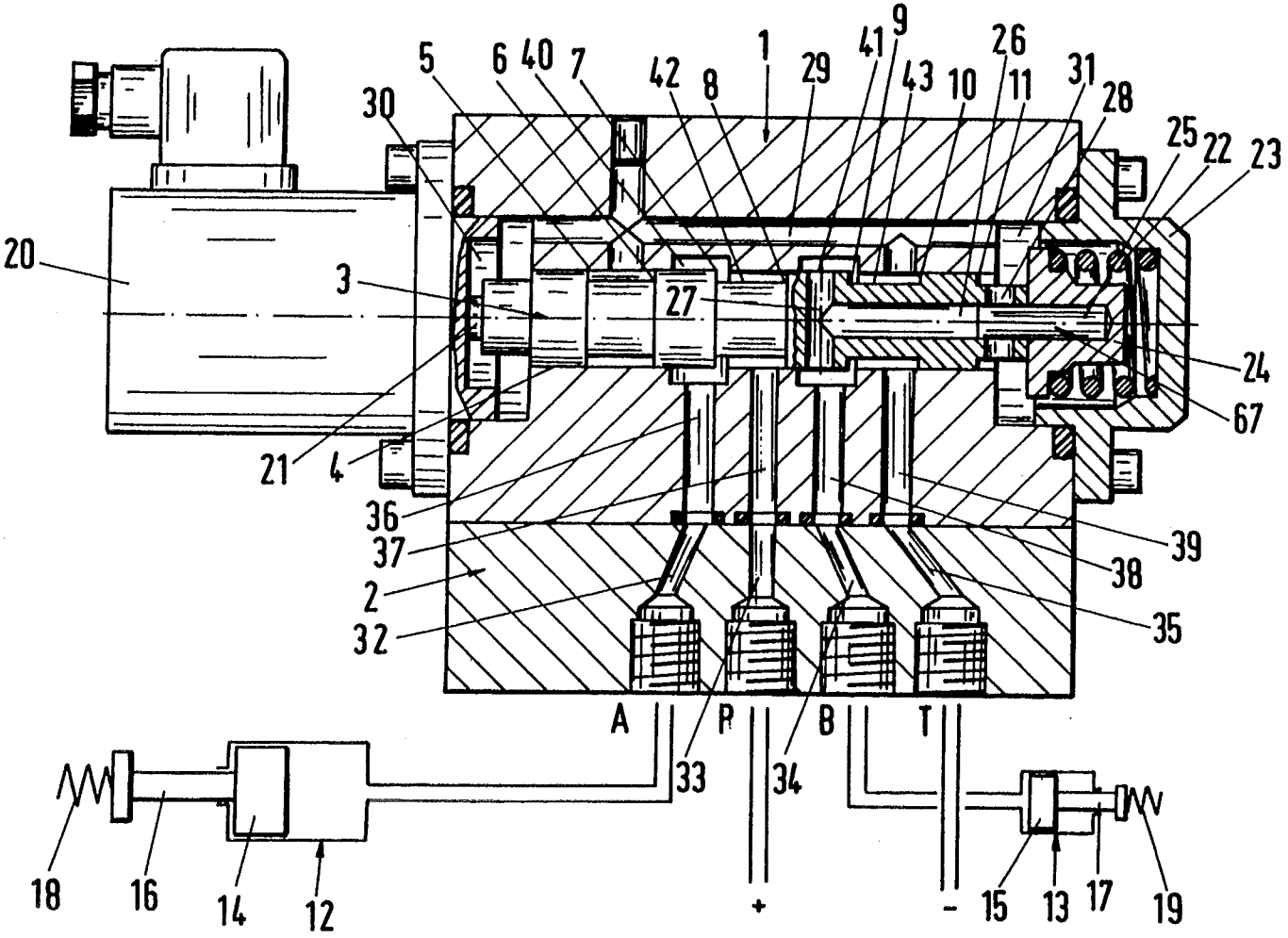
FIG. 1 is a cross-sectional view showing a valve arrangement having features in accordance with the present invention.

The valve arrangement according to FIG. 1 has a pathway valve 1, which is secured upon a connection plate 2. The pathway valve 1 has a switch-shift piston 3 that is journalled axially shiftable in a bore 4. The shift piston 3 has control edges 5, 6, 7, 8, 9 and 10.

The connection plate 2 is provided with an operating connection A, an operating connection B, a pressure connection P, and a return T to a tank in a known manner. Cylinder means 12 and 13 are connected respectively to the operating connections A and B. These two cylinders 12, 13 in the illustrated sample embodiment operate in opposing counter stroke. These cylinders respectively have a piston means 14, 15 which respectively is engaged with hydraulic medium. The piston rod means 16, 17 respectively carrying the piston means 14, 15 stand under a force of a pressure spring means 18, 19 which loads the piston rod means 16, 17 respectively in a direction toward the retracted positioning thereof. Accordingly, with the hydraulic medium, the corresponding piston means 14, 15 is shifted against the force of this return spring means 18, 19.

A magnet 20 is connected to the pathway valve 1 and the magnet plunger or tappet 21 thereof cooperates with the adjoining end of the shift piston 3. If the magnet 20 is switched on, then in a known manner the magnet plunger 21 is extended, so that it shifts the switch-shift piston 3 axially against the force of a return spring 22 into the desired switch-shift position. The return spring 22 is provided at the other end of the switch piston 3 and engages with one end thereof against a cover 23, which is screwed to the housing of the pathway valve 1 and which covers the bore 4 outwardly. With the other end thereof, the return spring 22 engages against a spring-dish plate member 24 which is seated upon an additional piston 25 that projects axially shiftable in an axial bore 26 of the switch-shift piston 3. The bore 26 is guided or extends approximately as far as to half the length of the switch-shift piston 3 and the bore 26 opens into a diametrical bore 27, which passes through the switch-shift piston 3 in a region between the control edges 8 and 9.

Near the end located at the spring dish-plate member 24, the bore 26 is crossed by a further diametrical bore 28, which passes through the switch-shift piston 3 in a region of the edge 11 and the adjoining switch piston end.

The pathway valve has a relief or discharge bore 29 located parallel to the switch-shift piston 3 and into which the tank connection T opens. The relief bore 29 extends between two spaces or chambers 30 and 31. In the chamber 31, which at one end is limited or bounded by the cover 23 there is located the spring dish-plate member 24.

The connection plate 2 has bores 32, 33, 34, 35, which are connected with the corresponding connections A, B, P, and T and relative to which corresponding bores 36, 37, 38, 39 of the pathway valve 1 are connected. The bores 36 and 38 of the pathway valve 1 associated with the operating connections A and B open respectively into an annular chamber means 40 and 41 of the bore 4. In regions between the two annular chambers 40 and 41 there is located an annular chamber 42 smaller in diameter into which the bore 37 belonging with the pressure connection P opens. The bore 39 belonging with the tank connection T finally opens into the annular chamber 43 of the bore 4, which has the same diameter as the annular chamber 42, In the position illustrated in FIG. 1, the cylinder 13 is relieved, which means that the pressure spring 19 thereof has pushed the piston rod 17 into its starting position. The other cylinder 12 stands under a pressure of a hydraulic medium, so that the piston 14 thereof is pushed back against the force of the spring 18. If now the other cylinder 13 is to be engaged with pressure, the magnet 20 is actuated so that the magnet plunger 21 is shifted axially against the switch-shift piston 3 in a known manner. As soon as the magnet plunger 21 respectively magnet armature 20 has carried out its advance stroke VH, it engages against the free end of the switch-shift piston 3 and shifts the piston 3 during a subsequent operating stroke into a switch-shift position, in which the hydraulic medium can flow to the cylinder 13. In this situation, the hydraulic medium flows via the pressure connection P and the bores 33 and 37 into the annular chamber 42. The switch-shift piston 3 is then shifted so far to the right in FIG. 1 that the control edge 7 closes the access of the hydraulic medium to the annular chamber 40, while the control edge 8 releases or makes free the path for hydraulic medium to the annular chamber 41. Thereby the hydraulic medium can come from the annular chamber 42 into the annular chamber 41 and from there via the bores 38 and 34 to the operating connection B. The piston is then shifted against the force of the spring 19 by hydraulic medium. Simultaneously now the other cylinder 12 is relieved or unloaded, so that the spring 18 can shift the piston 14 to the right in FIG. 1 into its end position.

During the pressure engagement of the cylinders 13, the hydraulic medium additionally comes into the diametrical bore 27 of the switch-shift piston 3. This diametrical bore 27 is so arranged that it is still located in the region of the annular chamber 41. The hydraulic medium flows accordingly via this diametrical bore 27 also into the axial bore 26 of the switch-shift piston 3. The additional piston 25 journalled therein accordingly stands under the pressure of the hydraulic medium and under the force exerted by the magnet plunger 21 and this force is directed counter to the force of the return spring 22. The magnet plunger 21 moves or travels against a non-illustrated end abutment. Then the magnet force has its greatest value or magnitude.

Figure 2:
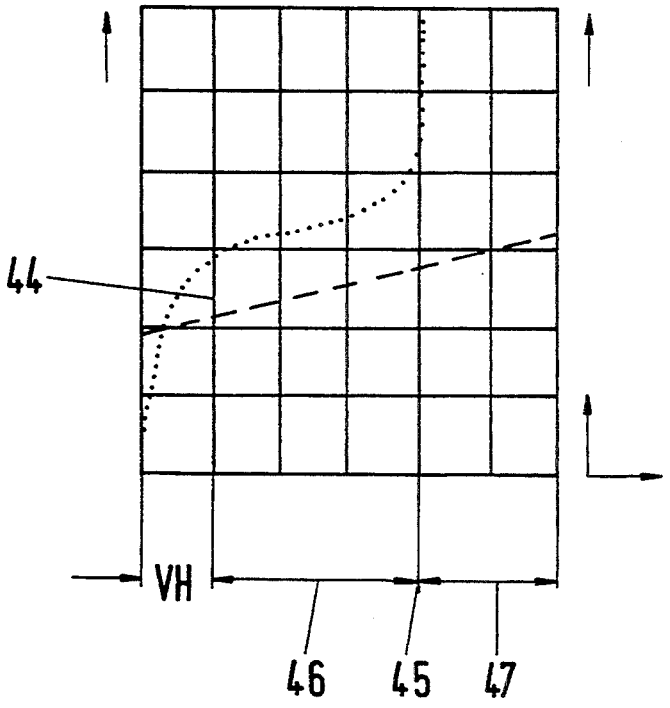
FIG. 2 is a diagram that shows a force-path-characterizing line of a magnet as well as a force-path-characterizing line of a reset spring of the inventive valve arrangement according to FIG. 1.

These foregoing conditions are illustrated and represented by a dash or dotted line in the magnet force-path-diagram in FIG. 2. At a point 44, the magnet plunger 21 after the terminated advance stroke VH comes into engagement against the shift piston 3. The magnet force increases with increasing shifting path movement 46 of the magnet plunger 21 and with that of the shift piston 3. At the point 45, the magnet plunger 21 reaches its end abutment, so that now the magnet force rises strongly. In FIG. 2 there is additionally shown and illustrated the force-path-characterizing line of the reset-return spring 22 of the pathway valve 1. This force increases continuously, as soon as the magnet plunger 21 is shifted. As soon as the magnet plunger 21 has reached its end position 45 and the hydraulic medium is further supplied via the pressure connection P, the pressure effective upon the additional piston 25 becomes greater than the reset-return force, so that it is shifted against the force of the return spring 22 (stroke 47). The additional piston 25 with that releases or opens the diametrical bore 28 of the shift piston 3 so that the hydraulic medium now can flow via the bore 26 and the diametrical bore 28 into the chamber 31 and from there via the relief bore 29 to the bore 39 which is connected with the tank connection T of the connection plate 2. Accordingly, with that the hydraulic medium can flow to the tank connection and can limit the hydraulic pressure. The additional piston 25 accordingly with that in connection with the diametrical bore 28 forms a pressure-limiting valve 67, which limits an impermissible high pressure build-up. This pressure-limiting valve 67 is accommodated and installed within the shift piston 3, so that the pressure-limiting valve 67 has no additional space requirement. Particularly with the described valve arrangement there is not necessary any additional intermediate plate device as provided with the known valve arrangement referred to in the background to the invention.

If on the other hand the cylinder 12 is to be engaged again, the magnet 20 is turned off, so that the magnet plunger 21 under the force of a non-illustrated reset-return spring or return spring 22 again travels back into its starting position. The reset-return spring 22 via the spring-dish plate member 24 shifts the additional piston 25 back again into the blocking position illustrated in FIG. 1, in which the additional piston 25 closes the diametrical bore 28. As soon as the spring dish-plate member 24 comes into engagement against the shift piston 3, this is shifted again under the force of the return spring 22 into the other shift position illustrated in FIG. 1. Now the connection from the pressure connection P to the operating connection B of the cylinder 13 is closed, while the annular chamber 40 is connected in communication with the annular chamber 42. The hydraulic medium therefore can come from the pressure connection P via these annular chambers into the bores 368 and 32 and with that to the operating connection A of the cylinder 12. The piston 14 thereof is then shifted into the pressure position illustrated in FIG. 1 by the hydraulic medium acting against the force of the return spring 18. The return spring 19 of the other cylinder 13 now shifts the piston 15 into the relief or unloading position illustrated in FIG. 1. The hydraulic medium no longer standing under pressure is then displaced via the operating connection B and the bores 34, 38 from the annular chamber 41 into the annular chamber 43 and from there via the bores 39, 35 to the tank connection T.

From FIG. 2 there is apparent and results that the operating stroke 46 of the shift piston 3 lies between the abutment- or engagement-points 44 and 45 of the magnet plunger 21. The opening stroke 47 of the additional piston 25 joins with the operating stroke 46. This opening stroke 47 assures that the hydraulic pressure effective upon the piston 15 of the cylinder 13 does not assume or take on impermissible high values, but rather is limited to a prescribed and predetermined value. The level or magnitude of this pressure can be set or adjusted by the return force of the spring 22. For example, the cover 23 can be provided with a non-illustrated thread portion against which the return spring 22 abuts and engages. Via more or less further screwing-in of the threaded portion into the cover 23, the force of the return spring 22 can be set and adjusted with a fine feeling or sensitive manner. Thereby the valve arrangement can be matched and adapted simply and accurately to the most differing employment and application situations. It is thereby possible to set and adjust the particular respectively permissible maximum pressure.

Figure 3:
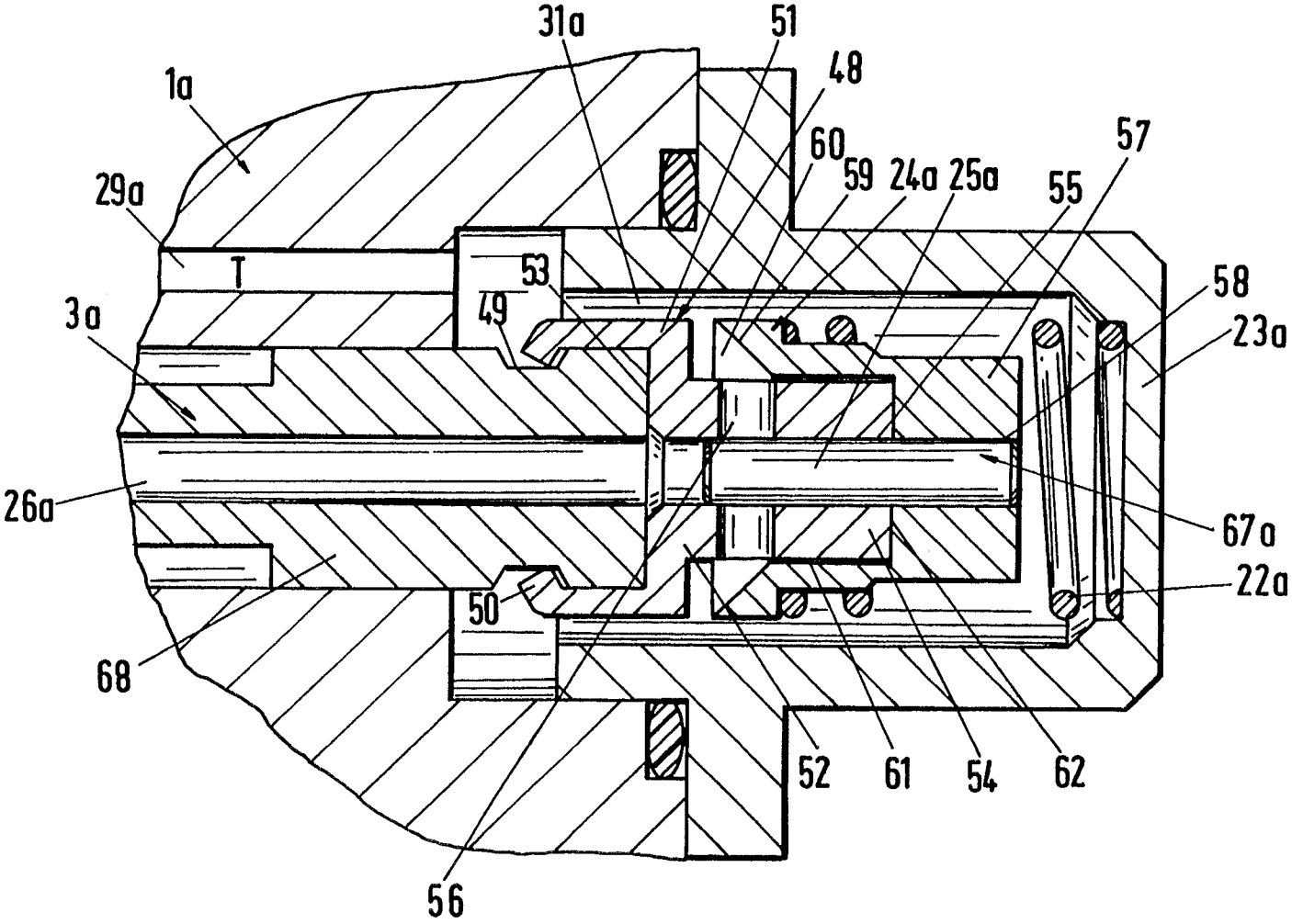
FIG. 3 is a fragmentary, enlarged cross-sectional view of a part of a second embodiment of the inventive valve arrangement.

With the sample embodiment according to FIG. 3, the additional piston 25*a* likewise is journalled in a bore of the shift piston 3*a*, the end of which lying adjacent to the cover 23*a* of the pathway valve 1*a* is formed by an adapter piece or part 48. Via the adapter part 48 there results the advantage that the diameter of the additional piston 25*a* is not dependent upon the dimensioning of the shift piston 3*a*. The shift piston 3*a* adjoining the adapter part 48 has an annular groove 49, into which the adapter part 48 engages with a surrounding edge 50. The adapter part 48 has a sleeve portion 51, with which it is seated upon an end of a base body 68 of the shift piston 3*a* and a free end or face side thereof bordered there around. The bottom 52 of the sleeve part 51 lies flat against the end or face side 53 of the base body 68. As to the sleeve part 51 there is connected an extension 54 which advantageously is constructed integral or unitary with the sleeve part 51 and the outer diameter thereof is smaller than the outer diameter of the sleeve part or portion 51 and preferably also is smaller than the outer diameter of the base body 68. The extension 54 serves as a journalling support and guide for the additional piston 25*a* and with that for the spring dish-plate member 24*a* against which one end of the return spring 22*a* for the shift piston 3*a* engages. With the other end thereof, the return spring 22*a* engages on the other hand against the cover 23*a*.

The extension 54 has a longitudinal bore 55 passing centrally thereof which also passes through the bottom 52 of the sleeve part or portion 51. The axial longitudinal bore 55 is oriented and aligned with the bore 26*a* of the base body 68, accordingly forming a continuation of this bore 26*a*. The additional piston 25*a* is journalled axially shiftable in the longitudinal bore 55. The longitudinal bore 55 passes through a diametrical bore 56, which passes through the extension 54 of the adapter piece or part 48. Accordingly with that the bore 26*a* of the base body 68 is connected via the longitudinal bore 55 and the diametrical bore 56 of the adapter piece 48 with the space or chamber 31*a* in connection and in communication therewith.

The spring dish-plate member 24*a* is constructed as a sleeve, which has a bottom 57. It has a central bore 58 passing there through in which the additional piston 25*a* is axially held or secured.

The end of the spring dish-plate member 24*a* away from the bottom 57 is provided with a conical surface opening in a direction upon the bottom 52 of the sleeve part 51 and this conical surface 59 together with the oppositely located underside of the bottom 52 of the sleeve part 51 forms a through-flow region or area 60 for the hydraulic medium and tapering at an incline outwardly. The spring dish-plate member 24*a* surrounds the extension 54 of the adapter part 48 with a small or nominal radial play 61. During the relative shifting between the spring dish-plate member 24*a* and the adapter piece 48 there is formed a space or chamber 62 between the bottom 57 of the spring dish-plate member 24*a* and the end or face side of the extension 54 with the volume of this chamber 62 changing or differing dependent upon the stroke of the additional piston 25*a*. This chamber 62 is connected with the tank connection T via the annular gap 61. The hydraulic medium can flow through into the annular chamber 61 only with pressure drop or decrease. Thereby there is assured an excellent and outstanding damping of the additional piston 25*a*, which thereby cannot be caused to oscillate, swing or vibrate in the operation of the valve arrangement. This valve arrangement is therefore characterized and distinguished by a very high noise damping. Also, as a consequence of the damping of the additional piston 25*a*, no pressure pulsations arise and occur therewith.

The valve arrangement according to FIG. 3 moreover is constructed identically as the sample embodiment according to FIG. 1. Also the manner of operation of this valve arrangement is basically the same as with the previous sample embodiment. If the magnet plunger 21 of the magnet 20 comes into engagement or abutment positioning against the abutment of the magnet, then the additional piston 28*a* via the hydraulic medium subsequently is shifted against the force of the return spring 22*a* in the bore 55 of the adapter part 48, whereby the diametrical bore 56 is released or made open and free. The hydraulic medium can then flow in the described manner via the diametrical bore 27 (FIG. 1) of the shift piston 3*a*, the bores 26*a* and 55 into the diametrical bore 56. There the hydraulic medium comes into the chamber 31*a* in which the relief bore 29*a* opens. In this manner the pressure can be limited in the abutment or engagement position of the magnet plunger 21, since the hydraulic medium can flow in the described manner via the relief bore 29*a* to the tank connection T. If thereby the conical surface 59 has flow there against, there is produced a counter force effective additionally against the force of the return spring 22*a*, via which the additional piston 25*a* is shifted further into its opening position, without any pressure increase or pressure rise being necessary and required in the hydraulic system.

The sample embodiment according to FIG. 3 is characterized and distinguished on the other hand again by its simple constructive arrangement and embodiment. The additional piston 25*a* in connection with the diametrical bore 56 again in turn forms a pressure limiting valve 67*a*, which is accommodated and installed within the structural space of the pathway valve 1*a*. Thereby this valve arrangement, as also the embodiment according to FIG. 1, has only a very small or nominal space requirement and can now also be installed and employed where narrow and close space conditions prevail, respectively the structural volume cannot be exceeded. Additionally this valve arrangement is characterized and distinguishable by the described high damping of the additional piston 25*a* and the high noise damping connected therewith, the reduction of pressure pulsations and the extremely small or nominal additional costs for the pressure-limiting valve.

With the sample embodiments according to FIGS. 1 and 3 in place of the diametrical bores 28 and 56 there can also be provided an annular passage or channel. Such a construction in contrast to the radially extending bores has an advantage that the through-flow strengthening or intensification can be greater than with radial bores. The additional piston means 25, 25*a* with the embodiments according to FIGS. 1 and 3 can be a simple and cost-advantageous bearing needle.

Figure 4:
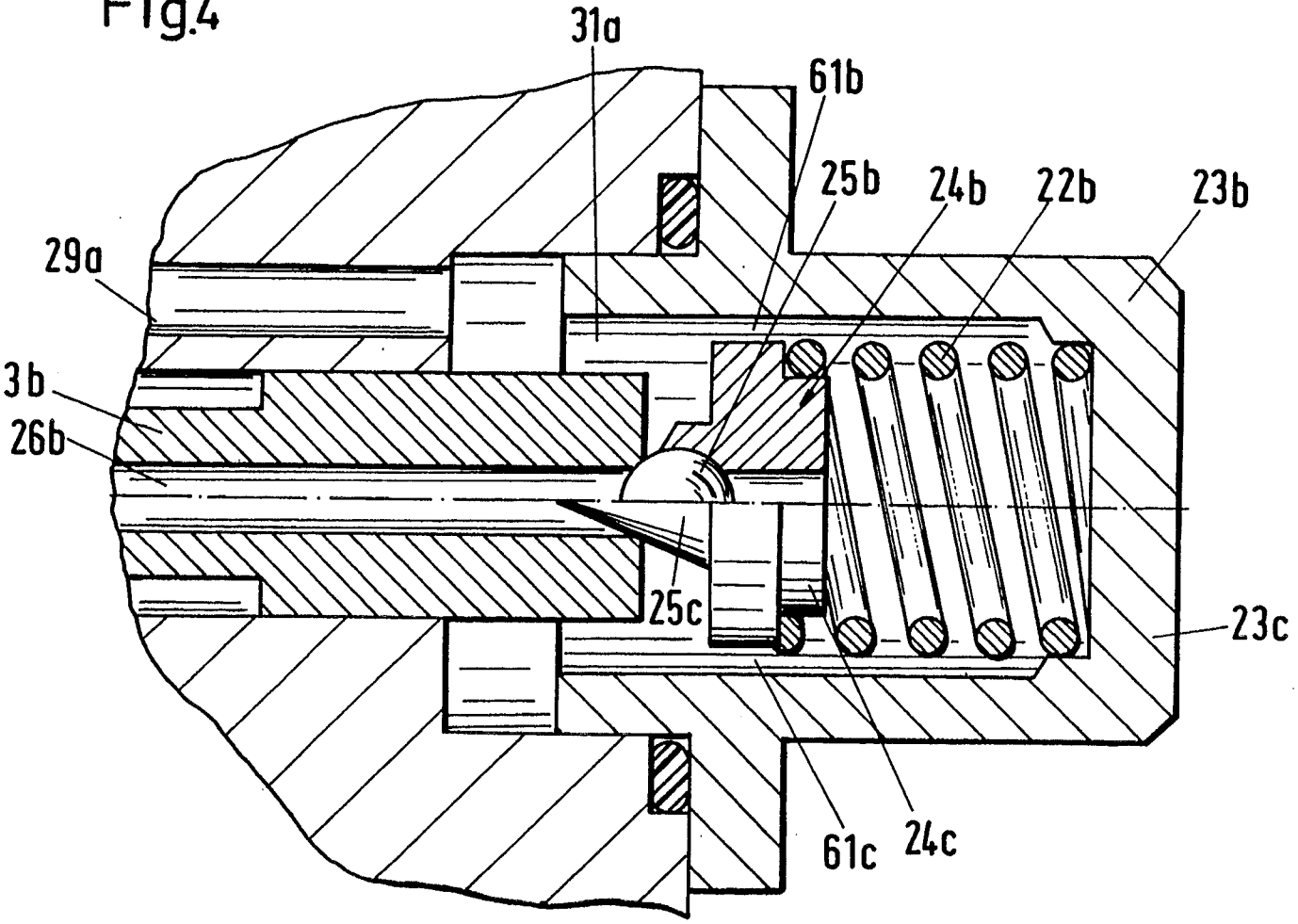
FIG. 4 is a fragmentary, enlarged cross-sectional view of further embodiments and features of valve arrangements in accordance with the present invention.

FIG. 4 shows two embodiments of valve members, which can be employed in place of the additional piston means for the pressure-limitation valve. In the upper half of FIG. 4, the valve member 25*b* is constructed as a sphere or ball, upon which the spring disk-plate member 24b for the return spring 22b abuts or engages. The sphere or ball 25b closes the bore 26b of the shift piston 3b.

In the lower half of FIG. 4 the valve member is embodied as a cone 25c which is advantageously constructed integral and unitary with the spring dish plate member 24c for the return spring.

These valve members 25b, 25c release or make free the bore 26b of the shift piston 3b upon exceeding of the force generated by the return springs so that the hydraulic medium can flow away or discharge in the described manner via the chamber 31a and the relief bore 29a to the tank connection T.

Via corresponding dimensioning of the annular gap 61b, 61c between the spring dish-plate member 24b, 24c and the bore wall of the cover 23b, 23c there also can be attained the damping with this embodiment which also was described in conjunction with FIG. 3.

In summary, the present invention concerns a valve arrangement including a pathway valve, of which the shift piston is shiftable by a plunger or tappet of a magnet against a return force and including a pressure valve which has a valve member that is adjustable against a return force. A valve member 25, 25a, 25b of the pressure valve 67, 67a, 67b is arranged on the shift piston 3, 3a, 3b of the pathway valve 1, 1a, 1b.

The valve member 25, 25a, 25b of the pressure valve 67, 67a, 67b is adjustable relative to the shift piston 3, 3a, 3b upon exceeding of a predetermined hydraulic pressure against a reset or return force for opening of the through-flow cross section 28, 56, 56b to the tank.

The valve member 25, 25a, 25b is a piston shiftable in a bore 26; 26a, 55; 26b, 55b of the shift piston 3, 3a, 3b.

The valve member 25, 25a, 25b is a valve body, exemplified by a ball, a cone and the like cooperating with a bore 26; 26a, 55; 26b, 55b of the shift piston 3, 3a, 3b.

The bore 26; 26a, 55; 26b, 55b of the shift piston 3, 3a, 3b has an end-side valve seat for the valve body 25, 25a, 25b.

The shift piston 3 provides at least one transverse bore 28, preferably a diametrical bore, which forms the through-flow cross section for the hydraulic medium.

The axially extending bore 26 is connected via a further diametrical bore 27 with one of the connections A, B, P of the valve arrangement and opens into the transverse bore 28.

A spring dish-plate member 24, 24a, 24b for a reset return spring means 22, 22a, 22b is seated upon the valve member 25, 25a, 25b.

The spring dish-plate member 24, 24a, 24b is provided in a chamber of the valve arrangement connected with a tank connection T.

One end of the shift piston 3a, 3b is formed by an adapter piece 48, 48b in which the piston 25a, 25b of the pressure valve 67a, 67b is arranged axially shiftable.

The adapter piece 48, 48b provides at least one transverse bore 56, 56b, preferably a diametrical bore, as a through-flow cross section.

The spring dish-plate member 24a, 24b is journalled shiftable on the adapter piece 48, 48b via the piston 25a, 25b of the pressure valve 67a, 67b and surrounds the adapter piece 48, 48b with a small spacing or annular gap 61.

A damping chamber 62 is formed connected with the tank connection T via the annular gap 61 of nominal spacing during the relative shifting between the spring dish-plate member 24a, 24b and the adapter piece 48, 48b.

The spring dish-plate member 24a, 24b at its end toward the shift piston 3a, 3b has a conical surface 59, 59b, which generates a counter force directed against the spring dish-plate member 24a, 24b in the flow-encountering condition during shifting of the valve member 25a, 25b.

The present invention is, of course, in no way restricted to the specific disclosure of the specification and drawings, but also encompasses any modifications within the scope of the appended claims.

What we claim is:

1. A valve arrangement including a pathway valve, of which a shift piston is shiftable against a reset force of a return pressure spring engaging a spring dish-plate member via a plunger of a magnet, and including a pressure-limit valve which has a valve member that is adjustable against a reset force, comprising:

said valve member being part of the pressure-limit valve arranged on the shift piston of the pathway valve the valve member of the pressure valve standing under working pressure of hydraulic medium and upon exceeding of a predetermined hydraulic pressure being shiftable against a reset force of the return pressure spring for opening of a bore of the shift piston as a through-flow cross section to a tank of the hydraulic medium.

2. A valve arrangement according to claim 1, in which the valve member is a piston shiftable in a bore of the shift piston.

3. A valve arrangement according to claim 1, in which the valve member is a valve body cooperating with a bore of the shift piston.

4. A valve arrangement according to claim 3, in which the bore of the shift piston has an end-side valve seat for the valve body.

5. A valve arrangement according to claim 1, in which the shift piston provides at least one transverse bore, which forms the through-flow cross section for the hydraulic medium.

6. A valve arrangement according to claim 5, in which the bore of the shift piston is connected with connections of the valve arrangement via a further diametrical bore and opens into the transverse bore.

7. A valve arrangement according to claim 1, in which a spring dish-plate member for a reset spring is seated upon the valve member.

8. A valve arrangement according to claim 7, in which the spring dish-plate member is provided in a chamber of the valve arrangement connected with a tank connection.

9. A valve arrangement according to claim 1, in which one end of the shift piston is formed by an adapter piece, in which the pressure valve is arranged axially shiftable.

10. A valve arrangement according to claim 9, in which said adapter piece provides at least one transverse bore, as a through-flow cross section.

11. A valve arrangement according to claim 9, in which the spring dish-plate member is journalled shiftable on said adapter piece via the pressure valve.

12. A valve arrangement according to claim 11, in which a damping chamber is formed connected with the tank connection via an annular gap during relative shifting between the spring dish-plate member and said adapter piece.

13. A valve arrangement according to claim 11, in which the spring dish-plate member at an end thereof toward the shift piston provides a conical surface, which in a flow-encountering condition with shifted valve member generates a counter force directed against the reset force effective upon the spring dish-plate member.

14. A valve arrangement according to claim 9, in which said adapter piece provides at least one diametrical bore as a through-flow cross section.

15. A valve arrangement according to claim 9, in which said adapter piece provides at least one bore means as a through-flow cross section.

16. A valve arrangement according to claim 1, in which the valve member is a ball cooperating with a bore of the shift piston.

17. A valve arrangement according to claim 1, in which the valve member is a cone cooperating with a bore of the shift piston.

18. A valve arrangement according to claim 1, in which the shift piston provides at least one diametrical bore which forms the through-flow cross section for the hydraulic medium.

19. A valve arrangement according to claim 18, in which the bore of the shift piston is connected with connections of the valve arrangement via a further diametrical bore and opens into the bore of the shift piston.

20. A valve arrangement according to claim 1, in which the shift piston provides at least one bore means which forms the through-flow cross section for the hydraulic medium.

* * * * *

UNITED STATES PATENT AND TRADEMARK OFFICE

CERTIFICATE OF CORRECTION

PATENT NO. : 5,417,241

DATED : May 23, 1995

INVENTOR(S) : Tischer et al

It is certified that error appears in the above-indentified patent and that said Letters Patent is hereby corrected as shown below:

Title page: Item [73], Line 1, Column 1, cancel "Hydraulic" and insert -- Hydraulik --.

Signed and Sealed this

Twenty-fifth Day of July, 1995

*Attest:*

Bruce Lehman

BRUCE LEHMAN

*Attesting Officer*

*Commissioner of Patents and Trademarks*